US010950372B2

(12) United States Patent
Zhou et al.

(10) Patent No.: US 10,950,372 B2
(45) Date of Patent: Mar. 16, 2021

(54) SURFACE MOUNTED FUSE DEVICE HAVING POSITIVE TEMPERATURE COEFFICIENT BODY

(71) Applicant: Littelfuse, Inc., Chicago, IL (US)

(72) Inventors: Zhiyong Zhou, Shanghai (CN); Jianhua Chen, Chicago, IL (US); Chun-Kwan Tsan, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/755,747

(22) PCT Filed: Oct. 19, 2017

(86) PCT No.: PCT/CN2017/106820

§ 371 (c)(1),
(2) Date: Apr. 13, 2020

(87) PCT Pub. No.: WO2019/075685

PCT Pub. Date: Apr. 25, 2019

(65) Prior Publication Data

US 2020/0328015 A1 Oct. 15, 2020

(51) Int. Cl.
*H01C 7/02* (2006.01)
*H01C 1/14* (2006.01)

(52) U.S. Cl.
CPC ..... *H01C 7/027* (2013.01); *H01C 1/1406* (2013.01); *H01C 7/021* (2013.01)

(58) Field of Classification Search
CPC ..... H01C 7/027; H01C 1/1406; H01C 7/021
USPC ..... 338/22 R
See application file for complete search history.

(56) References Cited

U.S. PATENT DOCUMENTS

| | | | | |
|---|---|---|---|---|
| 6,172,591 | B1 | 1/2001 | Barrett | |
| 2002/0140540 | A1* | 10/2002 | Chen | H01C 7/02 338/22 R |
| 2004/0099846 | A1 | 5/2004 | Lee et al. | |
| 2006/0152329 | A1* | 7/2006 | Bjorsell | H01C 1/148 338/22 R |
| 2011/0297891 | A1* | 12/2011 | Mercx | C08L 23/06 252/511 |
| 2014/0091896 | A1* | 4/2014 | Wang | H01C 1/08 338/22 R |
| 2015/0235744 | A1* | 8/2015 | Chen | H01C 7/027 338/22 R |

FOREIGN PATENT DOCUMENTS

| | | | |
|---|---|---|---|
| CN | 1993778 | A | 7/2007 |
| CN | 101316673 | A | 12/2008 |
| CN | 104795193 | A | 7/2015 |

OTHER PUBLICATIONS

International Search Report and Written Opinion dated Jul. 24, 2018 for PCT/CN2017/106820 filed Oct. 19, 2017.

* cited by examiner

*Primary Examiner* — Edwin A. Leon
*Assistant Examiner* — Iman Malakooti
(74) *Attorney, Agent, or Firm* — Kacvinsky Daisak Bluni PLLC

(57) ABSTRACT

A PPTC device including a PPTC body, a first electrode, disposed on a first side of the fuse component, a second electrode, disposed on a second side of the PPTC body, wherein the PPTC body comprises a polymer matrix and a conductive filler.

12 Claims, 4 Drawing Sheets

SURFACE MOUNTED FUSE DEVICE HAVING POSITIVE TEMPERATURE COEFFICIENT BODY

BACKGROUND

Field

Embodiments relate to the field of circuit protection devices, including fuse devices.

Discussion of Related Art

Polymer Positive temperature coefficient (PTC) devices may be used as overcurrent or over-temperature protection device, as well as current or temperature sensors, among various applications. In overcurrent or over-temperature protection.

In applications, the PPTC device may be considered a resettable fuse, designed to exhibit low resistance when operating under designed conditions, such as low current. The resistance of the PPTC device may be altered by direct heating due to temperature increase in the environment of the circuit protection element, or via resistive heating generated by electrical current passing through the circuit protection element. For example, a PPTC device may include a polymer material and a conductive filler that provides a mixture that transitions from a low resistance state to a high resistance state, due to changes in the polymer material, such as a melting transition or a glass transition. At such a transition temperature, sometimes called a trip temperature, where the trip temperature may often range from room temperature or above, the polymer matrix may expand and disrupt the electrically conductive network, rendering the composite much less electrically conductive. This change in resistance imparts a fuse-like character to the PPTC materials, which resistance may be reversible when the PPTC material cools back to room temperature.

The behavior of PPTC devices may be tailored to satisfy various criteria. For example, the trip-time may be designed with a certain minimum time for a give operating temperature, such as one second or so. Additionally, a PPTC device may be designed for a given maximum current so that the PPTC device will trip when the maximum current is exceeded. For example, over-current protection devices applied to motor vehicles are designed with superior heat dissipation capability as the vehicle may be isolated subject to environmental heating from sun or other factors. Depending upon the exact application, a target for hold current of such a PPTC device may be relatively higher or relatively lower.

With respect to these and other considerations, the present disclosure is provided.

SUMMARY

In one embodiment, a fuse device may include a PPTC body, a first electrode, disposed on a first side of the PPTC body, and a second electrode, disposed on a second side of the PPTC body. The PPTC body may comprise a polymer matrix and a conductive filler, wherein a current density for hold current of the PPTC device is less than 0.16 A/mm$^2$.

In another embodiment, a fuse device may include a PPTC body, a first electrode, disposed on a first side of the PPTC body, and a second electrode, disposed on a second side of the PPTC body, wherein the PPTC body comprises a polymer matrix and a conductive filler, wherein a current density for hold current of the PPTC device is greater than 0.4 A/mm$^2$.

In a further embodiment, a fuse device may include a PPTC body, a first electrode, disposed on a first side of the PPTC body, a second electrode, disposed on a second side of the PPTC body, wherein the PPTC body comprises a polymer matrix and a conductive filler, wherein the fuse body is elongated in a first direction, wherein the fuse body comprises a first elongated side and a second elongated side, extending along the first direction, and wherein the first side and the second side extend perpendicularly to the first direction.

DESCRIPTION OF EMBODIMENTS

Figure 1:
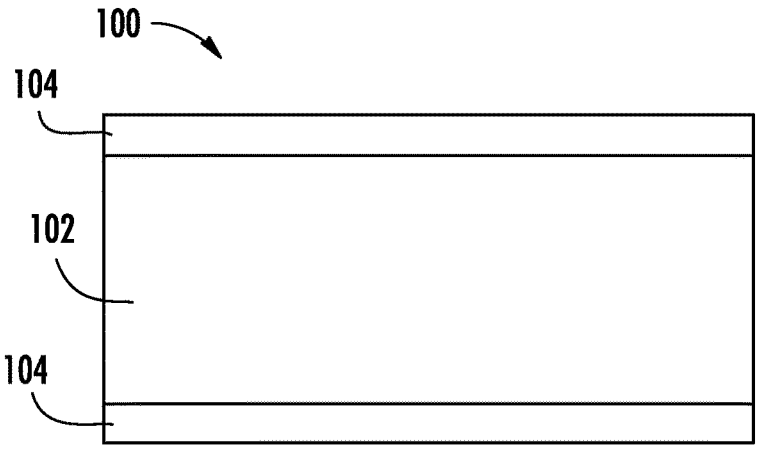
FIG. 1 illustrates a PPTC device according to embodiments of the disclosure.

The present embodiments will now be described more fully hereinafter with reference to the accompanying drawings, in which exemplary embodiments are shown. The embodiments are not to be construed as limited to the embodiments set forth herein. Rather, these embodiments are provided so that this disclosure will be thorough and complete, and will fully convey their scope to those skilled in the art. In the drawings, like numbers refer to like elements throughout.

In the following description and/or claims, the terms "on," "overlying," "disposed on" and "over" may be used in the following description and claims. "On," "overlying," "disposed on" and "over" may be used to indicate that two or more elements are in direct physical contact with one another. Also, the term "on,", "overlying," "disposed on," and "over", may mean that two or more elements are not in direct contact with one another. For example, "over" may mean that one element is above another element while not contacting one another and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

In various embodiments, novel device structures and materials are provided for forming a PPTC device, where the PPTC device is configured as a surface mounted device (SMD).

In various embodiments, an SMD is provided with a relatively high autotherm height (ATH) where and insulation layer is stacked on the PPTC surface. The autotherm height describes the resistance change between a low resistance ground state and a tripped state, where the number is measured in orders of magnitude. FIG. 1 illustrates a PPTC device 100, according to embodiments of the disclosure. The device 100 may include a PPTC body 102, described in more detail below, as well as electrodes 104. In this example, the electrodes 104 are disposed on opposite sides of the PPTC body 102, where current is conducted between one electrode and the other. According to various embodiments the PPTC body 102 may be formed as a composite, including a polymer matrix and a fill material. The polymer matrix may be formed of one polymer of a combination of polymers, such as semicrystalline polymers or crystalline polymers.

In some example, a polymer or polymers forming the PPTC body 102 may include polyvinylidene fluoride (PVDF), polytetrafluorethylene (PTFE), PFA(perflluorooxyalkane), polychlorotrifluoroethylene (PCTFE), low density polyethylene (LDPE), high density polyethylene (HDPE), LLDPE (linear low density polyethylene), HMPE (high molecular weight polyethylene), EVA (ethylene vinyl acetate copolymer), EBA (ethylene butyl acrylate copolymer).

In various embodiments, the volume fraction of polymer may range from 35 to 75 volume % of the PPTC body 102.

In various non-limiting embodiments, the melting point of the PPTC body 102 may be less than 320° C.

In particular embodiments, the polymer matrix of the PPTC body 102 may be composed of two or more polymers where the melting point differs between at least two of the two or more polymers.

According to various non-limiting embodiments, the volume fraction of conductive filler in the PPTC body 102 may range from 25% to 65%. In some embodiments, the conductive filler may be composed of metal particles, while in other embodiments the conductive filler may be composed of conductive ceramic particles. In still other embodiments, the conductive filer may be composed of a combination of metal particles and conductive ceramic particles. In various embodiments, the particle size of the conductive filler may range from 100 nm to 50 μm, and in particular embodiments, equal to 1 μm. The particle shape may be elongated in a given direction, or may be more equiaxed such as generally spherical shape. The embodiments are not limited in this context.

By appropriate choice of volume fraction of conductive filler, particle size, and conductivity of conductive filler, the resistivity of the PPTC body 102 may be arranged for appropriate resistivity. In various embodiments, the resistivity of the conductive filler may be below 500 μΩ-cm in various non-limiting embodiments.

In various embodiments, metal terminals and an insulation layer of a PPTC device may be stacked. In particular embodiments, a current density for hold current of the PPTC device 102 may be less than 0.16 A/mm$^2$, while the resistivity is higher than 0.2 Ω-cm. According to various embodiments, the ATH of the PPTC device 100 may exceed three decades (1000).

Figure 2A:
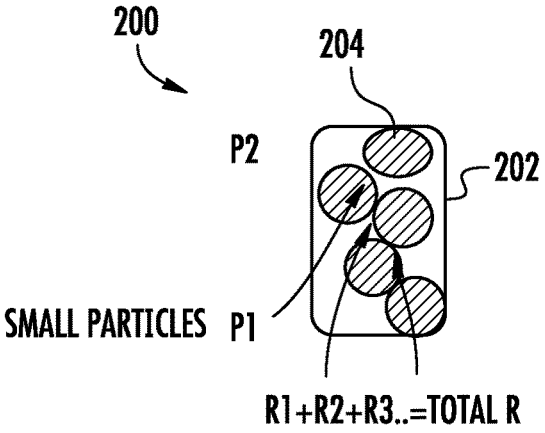
FIG. 2A illustrates a PPTC body that may be used as part of a PPTC device, according to embodiments of the disclosure.
Figure 2B:
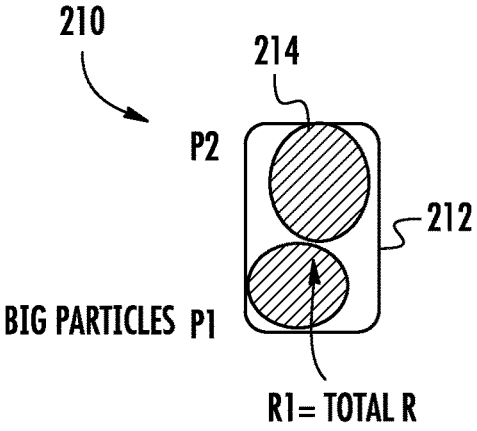
FIG. 2B illustrates a PPTC body that may be used as part of a PPTC device, according to additional embodiments of the disclosure.

In order to achieve a low hold current of less than <0.16 A/mm$^2$ the volume fraction of conductive filler may be reduced to the lower range of the aforementioned range for conductive filler. Alternatively, or in addition, the particle size of conductive filler particles may be decreased to increase the contact resistance. For example, the overall resistance of a PPTC material may be dominated by contact resistance between conductive filler particles. For a given thickness of a PPTC body, decreases in particle size leads to larger surface number of interfaces between conductive particle surfaces when current travels from a first side of the PPTC body to an opposite side of the PPTC body. The larger number of interfaces leads to a higher value of contact resistance, and accordingly a higher contact resistance, leading to a higher overall resistance of the PPTC material. FIG. 2A illustrates a PPTC body 200 that may be used as part of a PPTC device. The PPTC body 200 includes a polymer matrix 202 and conductive particles 204. In this example, the conductive particles 204 are relatively small compared to the thickness of the PPTC body 200 along the vertical direction in the figure, leading to multiple interfaces as current travels between point P1 and point P2. The multiple interfaces generate multiple contact resistance contributions, R1, R2, R3, and so forth, summing up to a relatively large total resistance. FIG. 2B illustrates a different PPTC body 210 that may be used as part of a PPTC device. The PPTC body 210 includes a polymer matrix 212 and conductive particles 214. In this example, the conductive particles 214 are relatively large compared to the thickness of the PPTC body 210 along the vertical direction in the figure, leading to just one interface as current travels between point P1 and point P2. Accordingly, just one contribution of contact resistance contributes to the total resistance of the PPTC body 210, which resistance is lower than in PPTC body 200.

Alternatively, or in addition, the aspect ratio of conductive filler particles may be decreased to increase the resistivity of the PPTC body 102. For example, low aspect ratio particles may have an aspect ratio between 1:1 and 1:1.5. As the aspect ratio decreases, the particle's percolation threshold increases, meaning that it requires more filler loading to achieve the same conductivity as for a high aspect ratio conductive particle. Said differently, a material made of a matrix having high aspect ratio conductive filler particles, such as aspect ratio greater than 2, reaches a given conductivity at a lower volume fraction of conductive filler particles than a material where the matrix has low aspect ratio particles.

Figure 3A:
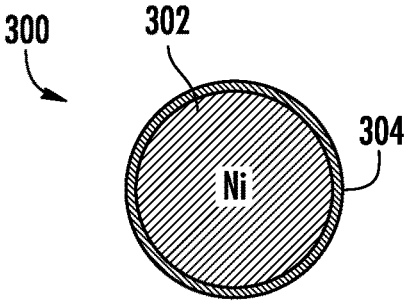
FIG. 3A and FIG. 3B illustrate alternative structures of a metal coated particle, according to embodiments of the disclosure.
Figure 3B:
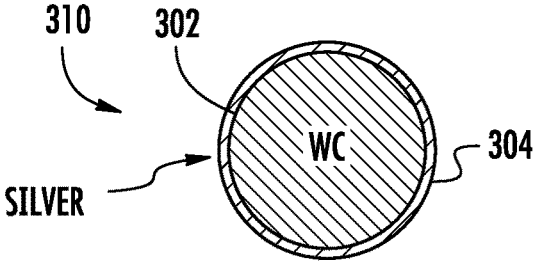

In various additional embodiments, the composition and structure of a PPTC material may be arranged to generate a high hold current density, such as greater than 0.4 A/mm$^2$, and a relatively low resistivity. In various embodiments, the high hold current density may be achieved by using a metal-coated particle as the constituent of a conductive filler. FIG. 3 illustrates an example of a metal coated particle 300, including a metal shell 302, and core 304. In various embodiments, the core 304 may be electrically conductive or electrically non-conductive. In some non-limiting embodiments, the metal used for the metal shell 302 may be silver, gold, ruthenium, nickel, or platinum. In some non-limiting embodiments, the material used for core 304 may be a metal, a conductive ceramic, carbon, a polymer, such as a non-conductive polymer, or a glass bead. For example, the metal coated particle 300 may be a metal particle, such as nickel (core 304) that is coated with a metal shell 302 formed from silver. Alternatively, core 304 may be a conductive ceramic such as tungsten carbide (WC) that is coated with a silver or other metal for metal shell 302, as shown in the variant of the metal coated particle 310 of FIG. 3B, where the core 304 is WC.

Figure 4A:
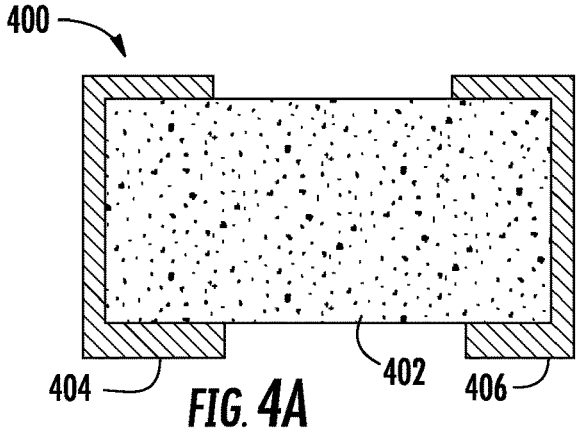
FIG. 4A and FIG. 4B show a PPTC device according to various embodiments of the disclosure.
Figure 4B:
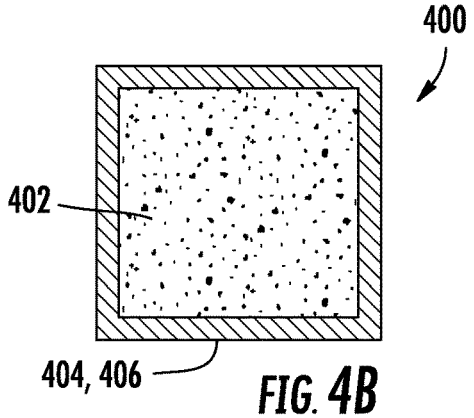

Turning now to FIG. 4A and FIG. 4B there is shown a PPTC device 400 according to various embodiments of the disclosure. FIG. 4A shows a side cross-sectional view, while FIG. 4B shows an end cross-sectional view. The PPTC device 400 generally is elongated along a first direction, such as along the Y-axis of the Cartesian coordinate system shown. Thus, the PPTC device has generally elongated surfaces parallel to the X-Y plane. The PPTC device 400 may be constructed with materials according to the aforementioned embodiments, where the PPTC body 402 includes a polymer, and conductive filler. In this embodiment, a first electrode 404 and a second electrode 406 are disposed on opposite ends of the PPTC device on end surfaces that are parallel to the X-Z plane. The first electrode 402 and the second electrode 404 may additionally circumferentially wrap around portions of the side surfaces as shown in FIG. 4B.

Figure 5A:
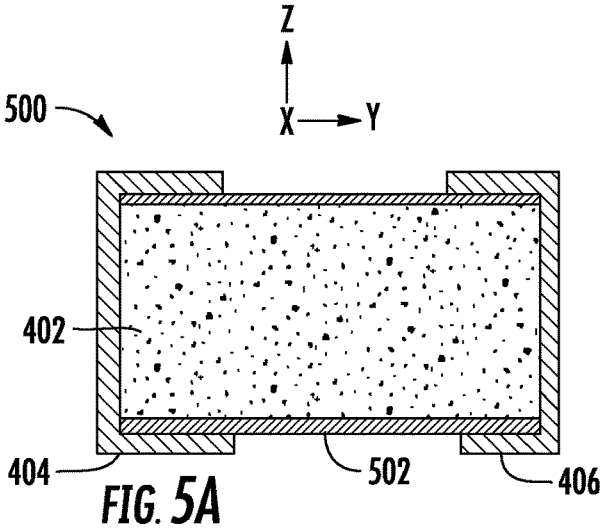
FIG. 5A and FIG. 5B show a PPTC device according to various other embodiments of the disclosure.
Figure 5B:
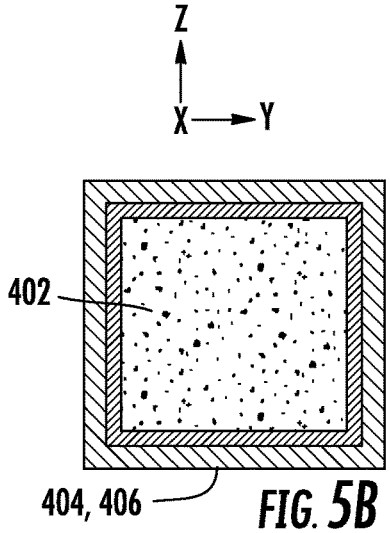
Figure 6A:
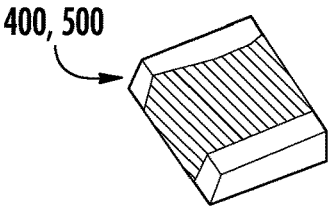
FIGS. 6A-6E show perspective views of variants of the PPTC devices of FIGS. 4A-5B.
Figure 6B:
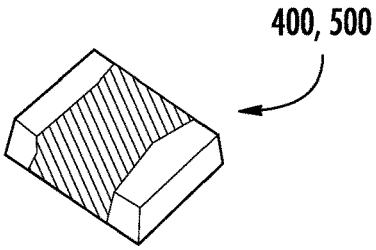
Figure 6C:
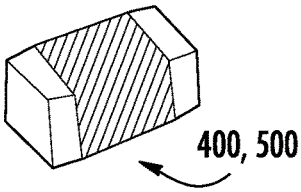
Figure 6D:
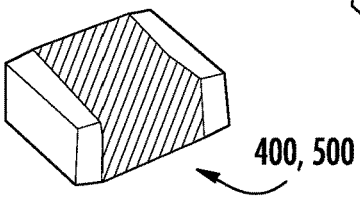
Figure 6E:
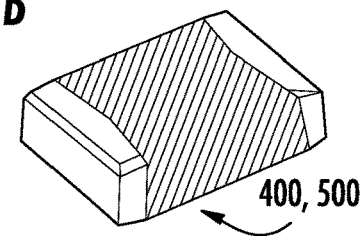

Turning now to FIG. 5A and FIG. 5B there is shown a PPTC device 500 according to various embodiments of the disclosure. FIG. 5A shows a side cross-sectional view, while FIG. 5B shows an end cross-sectional view. The PPTC device 500 generally is elongated along a first direction, such as along the Y-axis of the Cartesian coordinate system shown. Thus, the PPTC device has generally elongated surfaces parallel to the X-Y plane. The PPTC device 500 may be constructed with materials according to the aforementioned embodiments, where the PPTC body 402 includes a polymer, and conductive filler. In this embodiment, as in the embodiment of FIG. 4, a first electrode 404 and a second electrode 406 are disposed on opposite ends of the PPTC device on end surfaces that are parallel to the X-Z plane. The first electrode 402 and the second electrode 404 may additionally circumferentially wrap around portions of the side surfaces as shown in FIG. 5B. The PPTC fuse 500 may additionally include an insulator layer 502, disposed on side surfaces of the PPTC body 402. The insulator layer 502 may be an acrylic, a silicone, or other insulator material. The embodiments are not limited in this context.

FIGS. 6A-6E show perspective views of variants of the PPTC device 400 or PPTC device 500, where the relative size of the end surfaces (parallel to the X-Z plane) as well as side surfaces (parallel to the Y-Z plane or X-Y plane. In all cases, the variants are elongated along the Y-axis while the electrodes are arranged on end surfaces parallel to the X-Z plane. In various non-limiting embodiments, the dimension along two directions may be 0.08"×0.05", 0.06"×0.03", 0.04"×"0.02", 0.02"×0.01", and 0.01"×0.005" with less than 0.04" thickness in Z direction. In other embodiments, the dimensions along the two directions may be 0.12"×0.10", 0.08"×0.05", 0.06"×0.03", 0.04"×"0.02", 0.02"×0.01", and 0.01"×0.005."

In additional embodiments, conductive particles used as filler may be provided without coatings for use in a PPTC layer. Conductive Fillers in these embodiments may have a volume fraction from 25 to 65 volume % of a PPTC layer, where metal or conductive ceramic particles are used, where the resistivity of the conductive filler is less than 500 μΩ-cm. Such PPTC layers may be used with metal terminals in both ends of the PTC block. In these embodiments, for a surface mount device, the current density may be between 0.01-0.0.7 A/mm$^2$ and the PPTC resistivity may be between 0.1 and 20 Ω-cm.

Figure 7A:
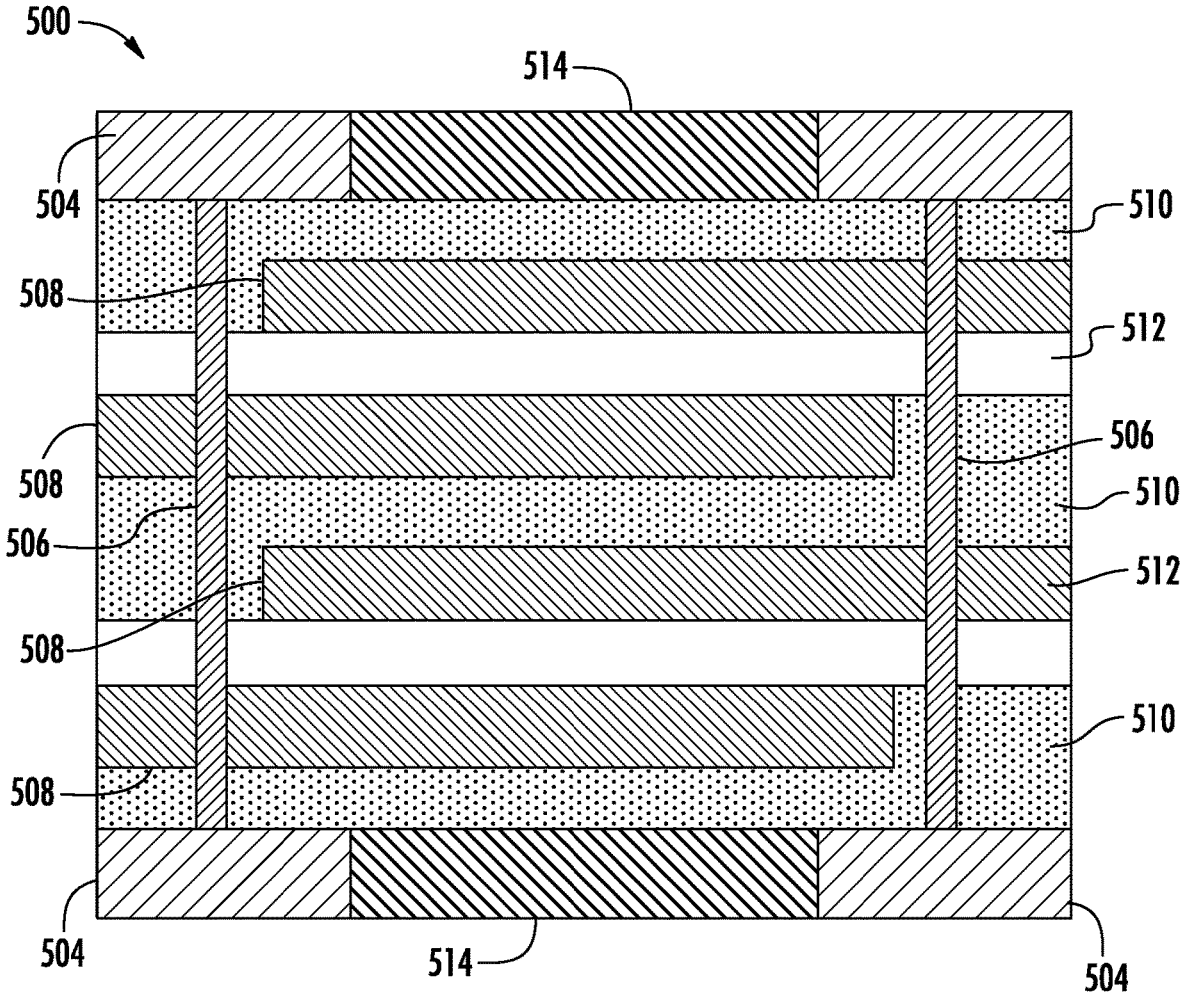
FIGS. 7A-7B depict a cross-section of PPTC devices according to additional embodiments of the disclosure.
Figure 7B:
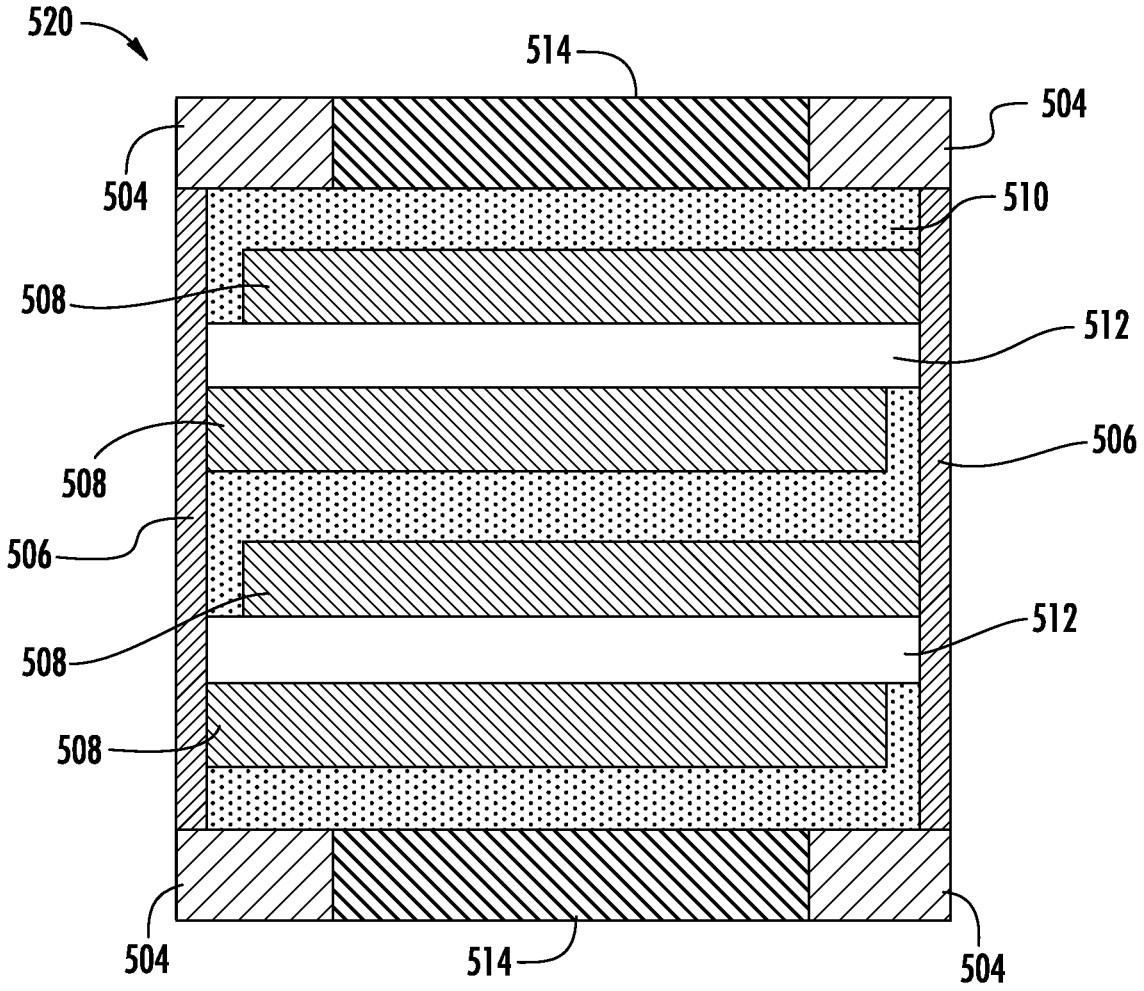

FIG. 7A and FIG. 7B depict side cross-sectional views of embodiments of a single layer surface mount PPTC device 500 and a double layer surface mount PPTC device 520, according to different embodiments of the disclosure. In these additional devices, the PPTC body may be formulated generally as described above, for operation at a low trip temperature, such as below 150° C. The PPTC device 500 and PPTC device 520 each have similar components, including metal electrodes 504, metal structures 506, metal foil electrode 508, PTC layer 512, insulation layer 510, and solder mask 514.

While the present embodiments have been disclosed with reference to certain embodiments, numerous modifications, alterations and changes to the described embodiments are possible while not departing from the sphere and scope of the present disclosure, as defined in the appended claims. Accordingly, the present embodiments are not to be limited to the described embodiments, and may have the full scope defined by the language of the following claims, and equivalents thereof.

What is claimed is:

1. A fuse device, comprising:

a PTC body;

a first electrode, disposed on a first side of the PPTC body;

a second electrode, disposed on a second side of the PPTC body;

wherein the PPTC body comprises a polymer matrix and a conductive filler, wherein a current density for a hold current of the PPTC body is less than 0.16 A/mm2; and wherein a particle size of the conductive filler is small compared to a thickness of the PPTC body between the first electrode and the second electrode, wherein multiple interfaces are formed between particles of the conductive filler between the first electrode and the second electrode, leading to increased resistance as current travels between the first electrode and the second electrode.

2. The PPTC device of claim 1, further comprising an insulating layer, the insulating layer extending circumferentially around the PPTC body along a first elongated side and a second elongated side, and along a third elongated side and a fourth elongated side.

3. The fuse device of claim 1, wherein a volume fraction of conductive filler in the PPTC body ranges from 25% to 40%.

4. The fuse device of claim 1, wherein an aspect ratio of conductive filler particles is between 1:1 and 1:1.5.

5. A fuse device, comprising:

a PPTC body;

a first electrode, disposed on a first side of the PPTC body; and a second electrode, disposed on a second side of the PPTC body;

wherein the PPTC body comprises a polymer matrix and a conductive filler, wherein a current density for a hold current of the PPTC body is greater than 0.4 A/mm2; and wherein a particle size of the conductive filler is large compared to a thickness of the PPTC body between the first electrode and the second electrode, wherein one or two interfaces are formed between particles of the conductive filler between the first electrode and the second electrode, leading to reduced resistance as current travels between the first electrode and the second electrode.

6. The fuse device of claim 5, wherein a volume fraction of conductive filler in the PPTC body ranges from 40% To 65%.

7. The fuse device of claim 5, wherein an aspect ratio of conductive filler particles is greater than 2.

8. The fuse device of claim 5, wherein the conductive filler comprises metal coated particles.

9. The fuse device of claim 8, wherein the metal coated particles comprise using a nickel core and a silver shell.

10. The fuse device of claim 8, wherein the metal coated particles comprise a WC core and a silver shell.

11. The fuse device of claim 5, further comprising an insulating layer, the insulating layer extending circumferentially around the PPTC body along a first elongated side and a second elongated side, and along a third elongated side and a fourth elongated side.

12. A fuse device, comprising:

a PPTC body;

a first electrode, disposed on a first side of the PPTC body; and a second electrode, disposed on a second side of the PPTC body;

wherein the PPTC body comprises a polymer matrix and a conductive filler, wherein the PPTC body is elongated in a first direction, wherein the PPTC body comprises a first elongated side and a second elongated side, extending along the first direction, and wherein the first side and the second side extend perpendicularly to the first direction; and wherein a particle size of the conductive filler is large compared to a thickness of the PPTC body between the first electrode and the second electrode, wherein one or two interfaces are formed between particles of the conductive filler between the first electrode and the second electrode, leading to reduced resistance as current travels between the first electrode and the second electrode.

* * * * *